US011136833B2

(12) United States Patent
Steine

(10) Patent No.: US 11,136,833 B2
(45) Date of Patent: Oct. 5, 2021

(54) FLOAT EQUIPMENT FOR A WELLBORE

(71) Applicant: Ace Oil Tools, Randaberg (NO)

(72) Inventor: Ken Erik Steine, Hafrsfjord (NO)

(73) Assignee: Ace Oil Tools, Randaberg (NO)

( * ) Notice: Subject to any disclaimer, the term of this patent is extended or adjusted under 35 U.S.C. 154(b) by 0 days.

(21) Appl. No.: 16/185,824

(22) Filed: Nov. 9, 2018

(65) Prior Publication Data

US 2019/0145187 A1 May 16, 2019

(51) Int. Cl.

| | |
|---|---|
| ***E21B 17/046*** | (2006.01) |
| ***E21B 17/14*** | (2006.01) |
| ***E21B 17/10*** | (2006.01) |
| ***E21B 10/26*** | (2006.01) |

(52) U.S. Cl.

CPC ..... *E21B 17/046* (2013.01); *E21B 10/26* (2013.01); *E21B 17/1064* (2013.01); *E21B 17/14* (2013.01)

(58) Field of Classification Search

CPC ..... E21B 17/046; E21B 33/0415; E21B 33/0422; E21B 31/18; E21B 17/0465; E21B 17/14; E21B 33/0353

See application file for complete search history.

(56) References Cited

U.S. PATENT DOCUMENTS

| | | | | |
|---|---|---|---|---|
| 3,040,405 | A | 6/1962 | Solum | |
| 3,095,644 | A | 7/1963 | Curry | |
| 6,401,820 | B1 | 6/2002 | Kirk et al. | |
| 7,100,713 | B2 * | 9/2006 | Tulloch | E21B 7/20 175/402 |
| 10,287,828 | B2 * | 5/2019 | Savage | E21B 4/02 |
| 10,538,975 | B2 * | 1/2020 | Rodriguez | E21B 17/1028 |
| 2004/0040704 | A1 | 5/2004 | Baker | |
| 2015/0191982 | A1 * | 7/2015 | Steine | E21B 17/12 166/241.6 |

FOREIGN PATENT DOCUMENTS

| | | | |
|---|---|---|---|
| GB | 2561866 | A | 10/2018 |
| WO | 2014011056 | A1 | 1/2014 |

OTHER PUBLICATIONS

Search Report issued on corresponding GB Application No. 1718645.3, dated Mar. 12, 2018.

* cited by examiner

*Primary Examiner* — Catherine Loikith

(74) *Attorney, Agent, or Firm* — Andrus Intellectual Property Law, LLP

(57) ABSTRACT

A float equipment attachment assembly includes a float equipment for mounting to a tubing string. The float equipment includes a tubular body and a plurality of gripping arms extending longitudinally away from the tubular body arranged to deflect radially inwards. An attachment sleeve has an inner diameter tapered to form a conical abutment portion. The attachment sleeve and float equipment are arranged axially around the tubing string and are pressed together. The gripping arms are deflected radially inward by the conical abutment portion to grip the tubing string to mount the float equipment to the tubing string.

21 Claims, 13 Drawing Sheets

FLOAT EQUIPMENT FOR A WELLBORE

CROSS-REFERENCE TO RELATED APPLICATIONS

This application claims priority to GB Patent Application No. 1718645.3 filed Nov. 10, 2017, which is incorporated herein by reference, in entirety.

BACKGROUND

In oil and gas production after boring a well bore a casing string is inserted into the drilled well bore. Typically mounted on the lower end of the casing string, or tubing string, is float equipment. Float equipment is generally used to guide casing past ledges and slough zones, provide a landing point for cementing plugs and to provide a back pressure valve to prevent cement from flowing into the inner diameter of the casing. Different float equipment mounted on the end of the casings serves a different purpose, that is, specific float equipment is used depending on the circumstance.

Examples of the different float equipment that can be used include a guide shoe, a float collar, a float shoe and a reamer shoe. Each of these items are well known in the art. For context, only a reamer shoe will be described here in detail.

After a well bore has been drilled, the well bore may contain a series of obstructions caused by ledges, debris or unstable wall formations. To clear these obstructions, a reamer shoe is mounted to the lower end of the casing string. The reamer shoe has a plurality of reaming members around the circumference of the body which help the casing to get past these well bore obstructions such as open hold bridges, sloughing, ledges and ridges. As the reamer shoe is run into the well bore, the casing string may be rotated or reciprocated which in turn rotates and reciprocates the shoe. Typically, fluid is also pumped through the casing string and out of port valves in the shoe to provide lubrication and to aid cementing operations.

As well as there being a large variety of different float equipment, there is also a large variation of reamer shoes for different applications. Each of the different reamer shoes is typically mounted to the casing string using a threaded connection. Typically, the inner diameter of the reamer shoe is larger than the outer diameter of the casing with a thread provided on the inner wall of the reamer shoe and the shoe screwed onto a thread on the outer wall of the casing to mount the shoe to the casing.

This threaded connection is problematic. For example each of the threads must be manufactured to a high degree of tolerance to reduce error and ensure effective mounting, particularly under load. Such a threaded connection also means that a reamer shoe must be manufactured for each different casing. Given that casing equipment does not conform to a standard size, each reamer shoe must match exactly to the size of the casing string. This means that many reamer shoes are required where different casing sizes may be used. The many different sized threads introduce significant expense and inventory overheads.

Additionally, the casing must also have a thread at one end which makes manufacture inefficient as threaded casings have to be welded onto the casing string. Moreover, a fit thread protector is typically needed in many implementations.

Problems associated with threaded mounting occur similarly in other float equipment, such as float shoes.

SUMMARY OF THE INVENTION

According to a first aspect of the present invention, a float equipment attachment assembly comprises: a float equipment for mounting to a tubing string, the float equipment comprising a tubular body and a plurality of gripping arms extending longitudinally away from the tubular body arranged to deflect radially inwards; and, an attachment sleeve, wherein the inner diameter of the attachment sleeve is tapered to form a conical abutment portion, wherein, when the attachment sleeve and float equipment are arranged axially around the tubing string and are pressed together, the gripping arms are deflected radially inward by the conical abutment portion to grip the tubing string to mount the float equipment to the tubing string.

Attachment in this way means that float equipment can be attached to a tubing string by only pressing the gripping arms into the sleeve. No pins, screws or welding are required to attach the float equipment to the tubing string. In addition, the diameter that the float equipment can be attached to can be within a relatively wide tolerance range as the variable inner circumference of the float equipment allows it to be easily attached to tubing strings with different outer diameters. In addition, the attachment of the gripping arms to the pipe due to the deflection of the arms allows a very strong gripping force to be applied to the tubing string. Further advantages include the simple and low cost of construction.

When compared to conventionally mounted float equipment, the mount of the invention allows the equipment to be mounted to different casings which reduces the need for multiple thread options and significantly reduces the cost of equipment manufacture and inventory overheads. The connection of the invention is independent of weight, grade and thread. The two piece design is press-fit together to secure the equipment to the casing off-line. The attachment mechanism delivers extremely high holding forces under all operating conditions.

Additionally, conventional float equipment takes a long time to install as the equipment must be threaded onto the casing. The press-fit connection of the invention is quick and easy and dramatically increases the speed of installation and reduces the overall installation time. Any type of shoe or equipment can be used on the tubing rather than being limited to one type by the installation overheads. The float equipment can also be installed using a hand-held tool, which further reduces the installation overheads.

Preferably, the float equipment further comprises a seal groove for retaining a seal, the groove arranged on an inner wall of the float equipment such that a seal can be created between the float equipment and the tubing string when the float equipment is mounted on the tubing string. In conventional float equipment the equipment is mounted by a thread to the end of the casing. The threaded connection does not typically allow for fluid or pressure leakage. The seal groove and seal provided in the float equipment prevents any fluid or pressure leakage. This may optionally allow fluid to be ejected straight out of the nose of the equipment.

More preferably the seal groove is annular and extends circumferentially around the inner wall of the tubular body. This seal groove may retain a seal to provide effective sealing. Even more preferably, the float equipment attachment assembly may further comprise an annular seal arranged on an inner wall of the tubular body.

Optionally, the float equipment may further comprise a casing abutment portion protruding inwardly from an inner wall of the tubular body so as to abut an end of the tubing string when the float equipment is slid over the tubing string. The casing abutment portion enables the equipment to be guided to an end of the tubing string and also helps the equipment to stay in place when the equipment hits the bottom of the well bore. Preferably, the casing abutment portion is annular and extends circumferentially around the inner wall of the tubular body.

Each gripping arm may comprise a plurality of gripping teeth arranged on an inner wall of the gripping arms. The gripping teeth provide a force on the tubing string after the arms are pressed into the tubing string that helps prevents axial or radial movement of the float equipment.

Preferably the teeth extend circumferentially around the inner wall of the gripping arms. Circumferentially arranged teeth in this way prevent axial movement of the float equipment.

More preferably, each male gripping arm may comprise at least one longitudinal slit in the circumferential gripping teeth. Even move preferably, each gripping arm may comprise five longitudinal slits. The longitudinal slits help to prevent radial movement of the float equipment.

The float equipment attachment assembly may further comprise a plurality of circumferential ridges on an outer wall of the male gripping arms which are arranged to cooperate with corresponding circumferential ridges on the inner wall of the sleeve to form a ratchet. The rachet prevents relative movement of the sleeve and float equipment after press-fitting.

The gripping arms may be tapered so that the outer diameter of the gripping arm increases from a tip of the gripping arms toward the tubular body. In this way, the tapered surface of the gripping arms meets the tapered inner diameter of the sleeve so that when pressed together the sleeve efficiently deflects the gripping arms inwards.

Preferably the float equipment may further comprise a tool groove extending circumferentially around an outer wall of the float equipment to receive a part of a setting tool. Thus the setting tool may be arranged at one side of the sleeve and in the groove to apply a force to move the sleeve and gripping arms relative to one another.

The float equipment may be a reamer shoe. When mounted on the tubing string using the attachment mechanism, the reamer shoe may be run into a well bore to remove obstructions and improve casing operations.

The reamer shoe may comprise an eccentric nose cone mounted on the tubular body. The nose cone may remove obstructions in the well bore when the reamer shoe is run into the well bore.

The float equipment may further comprise one or more channels extending through a wall of the float equipment to allow fluid communication between the tubing string and a well bore. Thus fluid inserted into the tubing string may be ejected from the float equipment and into the well bore or onto the wall of the well bore to provide lubrication for the float equipment and aid in removing obstructions.

Preferably the float equipment may further comprise an internal threaded portion for receiving a check valve. The threaded portion may receive a check valve having different properties and for regulating pressure in the tubing string.

The tubular body may comprise one or more reamer members or one or more spiral centraliser arms, or both. The reamer members may form a grinding section for removing obstructions in the wall of the well bore. The centraliser arms may maintain the float equipment centrally within the bore when the tubing string is run down the well bore.

The float equipment attachment assembly may further comprise a support ring adapted to reduce the effective inner diameter of the tubular body to conform to a conical threaded portion of the tubular string. Thus when the float equipment of the invention is adapted to existing tubing strings having a conical threaded portion, the support ring adds stiffness to the assembly to reduce a gap between the threaded portion of the tubing and the tubular body of the float equipment.

The tubular body may comprise a threaded connection for receiving a nose cone. Thus different nose cones may be substituted depending on application.

According to a second aspect of the invention there may be provided a float equipment according to the first aspect of the invention.

According to a further aspect of the invention there may be provided a method of mounting a float equipment to a tubing string comprising: sliding an attachment sleeve onto the tubing string; sliding a float equipment onto an end of the tubing string aligning a longitudinal axis of a substantial tubular end part of the attachment sleeve with a longitudinal axis of a substantial tubular end part of the float equipment; applying a force that moves an end part of the sleeve and an end part of the float equipment relatively toward each other along the longitudinal axis so that contact between the sleeve and the float equipment causes each of a plurality of gripping arms on an end part of the float equipment to deflect radially inward.

BRIEF DESCRIPTION OF DRAWINGS

An example of the present invention will now be described in detail with reference to the accompanying drawings, in which: An example of the present invention will now be described in detail with reference to the accompanying drawings, in which.

DETAILED DESCRIPTION

The present invention provides improved float equipment, particularly a reamer shoe, and an improved means for attaching float equipment to a pipe. Although the description may describe and illustrate an example of a reamer shoe, embodiments of the present invention may be applicable to any float equipment.

Figure 1:
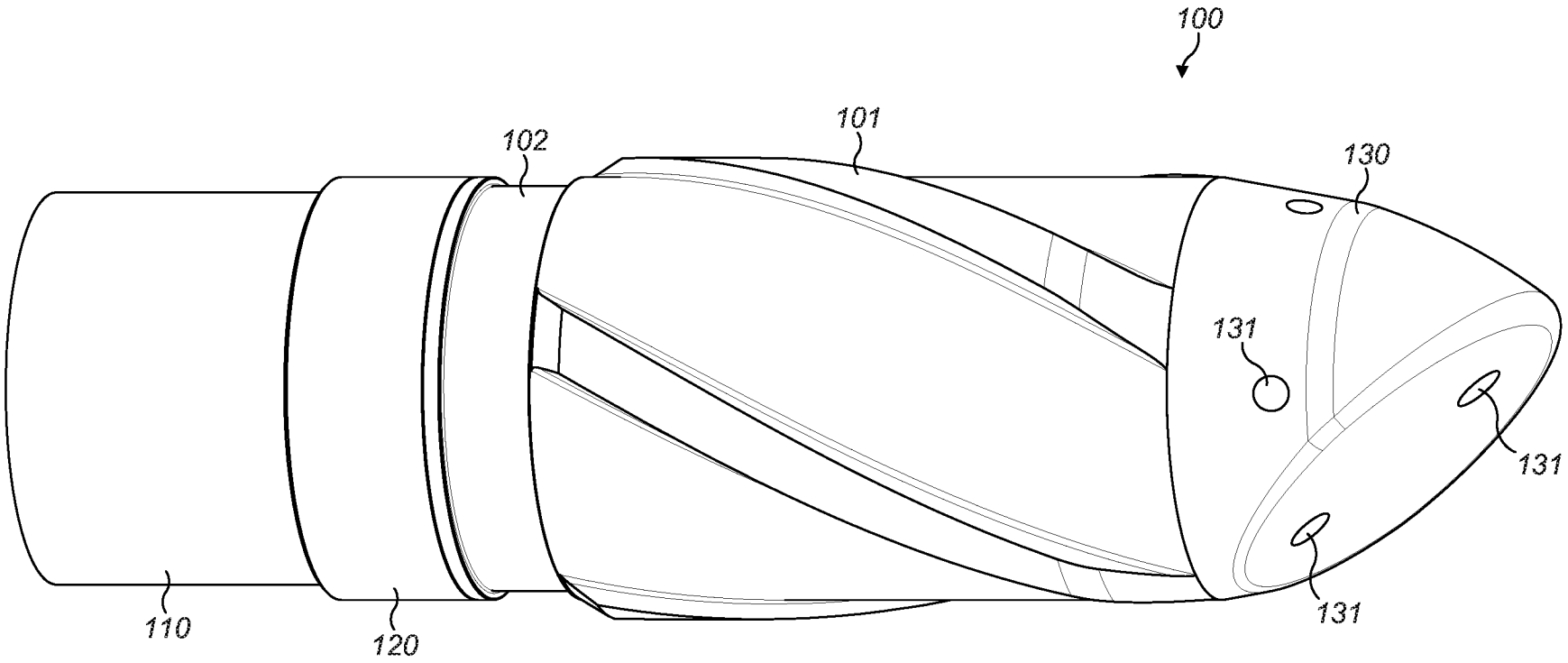
FIG. 1 illustrates float equipment and attachment sleeve assembly according to an embodiment of the present invention, particularly a reamer shoe, mounted onto a casing string.

FIG. 1 illustrates a reamer shoe 100 according to the present invention. The reamer shoe 100 is illustrated mounted onto a pipe 110. The reamer shoe 100 comprises a tubular portion or body having a male attachment portion (not shown) which cooperates with a female attachment sleeve 120 thereby forming a male-female connection. The sleeve 120 and attachment portion are press-fit together to mount the reamer shoe onto the pipe 110.

When mounted on the end of the pipe or casing string 110, the reamer shoe 100 and the casing string 110 are together run into a well bore. Fluid may be allowed to pass from the interior of the casing 110 to the exterior of the well bore to lubricate the surface of the reamer shoe 100. In use, the reamer shoe upon reaching an obstruction or irregularity in the bore wall may be reciprocated or rotated as required to remove or push aside the obstruction in preparing the bore for receiving casing. The casing operation can then be continued.

The words pipe, tubular, casing, casing string, tubing and tubing string may be used interchangeably throughout the present description to refer to a casing, the length of which is typically referred to as the casing string which is run into a well bore and to which float equipment is mounted.

As mentioned above, the reamer shoe 100 is formed of a tubular body. Arranged around the outside of the body is a plurality of spiral centraliser arms 101 which are arranged to position the reamer shoe 100 centrally within the bore. Spiral centraliser arms 101 are well known in the art. Around the outside of the body may also be arranged a plurality of reaming members or grinding sections which may be any known configuration, shape or material as would be understood by the skilled person. The reaming members and spiral centraliser arms 101 may each be configured for the particular purpose of the reamer shoe 100 and are not essential to the invention. The illustrated examples show four spiral arms extending longitudinally along the tubular body.

At an end of the reamer shoe 100 to be inserted into the bore that is, at the end of the shoe furthest away from the surface or rig, is a nose cone 130. The nose cone 130 is a substantially eccentric, conical shape with a plurality of channels 131 extending from the exterior of the shoe 100 to the interior to allow for fluid communication between the interior of the casing string and the periphery of the shoe 100. In this way, fluid pumped into the casing 110 from the surface may be ejected straight out of the nose 130 to lubricate the shoe 100 or to aid in clearing the obstructions. The nose cone 130 will be described in more detail below. The exact shape of the nose cone is not essential and is dependent upon application. Any number of channels 131 may be provided in the reamer shoe 100 to provide for fluid communication.

For reference, the shoe 100 may be described as having proximal and distal ends. The proximal end is that end of the shoe 100 which is proximal to the surface when the mounted shoe is run into the bore. The distal end is that end of the mounted shoe which is run into the bore first, that is, the leading end in use—the nose cone is arranged at the distal end of the shoe.

At the proximal end of the tubular body of the shoe 100, opposite to the nose cone 130, is an attachment portion for mounting the shoe 100 to the casing 110. In conventional float equipment the equipment is mounted to an end of the casing string using a threaded connection. The attachment mechanism of the invention mounts the shoe 100 to a side of the casing string 110 rather than the end.

Figure 2:
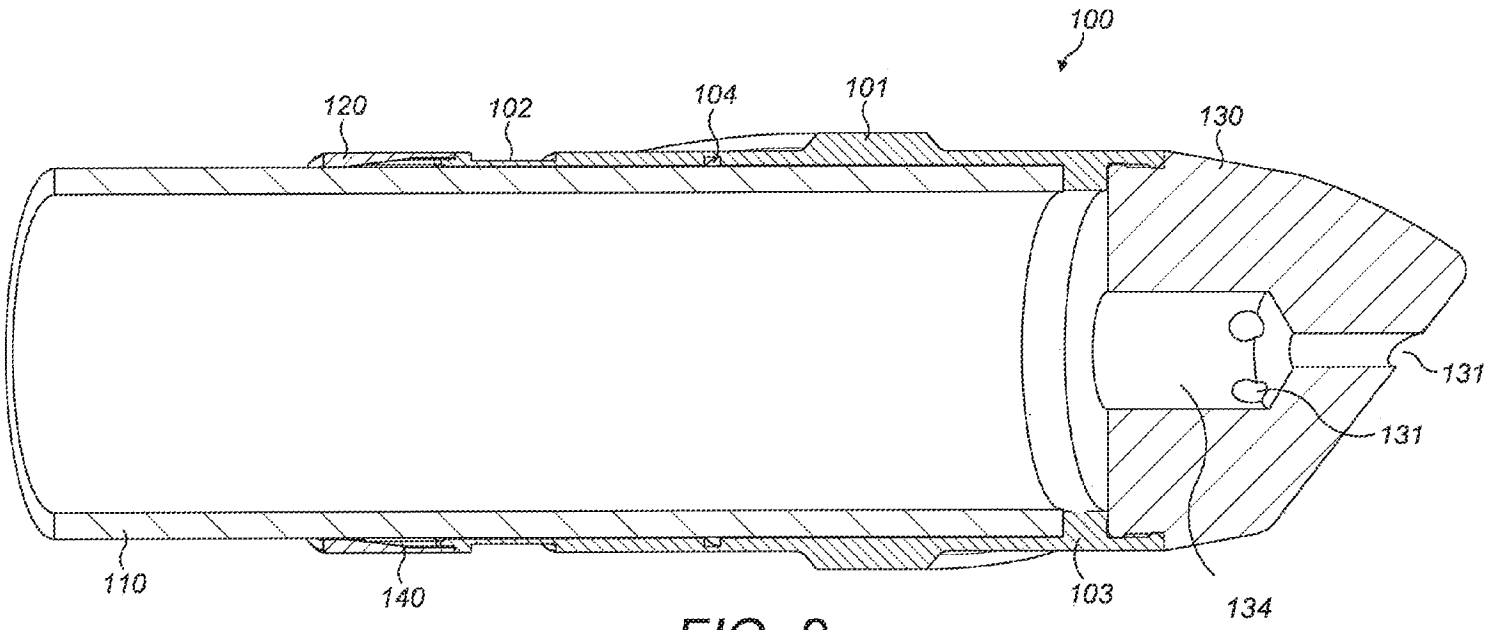
FIG. 2 illustrates a cross section of the mounted float equipment of FIG. 1.

FIG. 2 illustrates a cross section of the mounted reamer shoe 100, casing string 110 and attachment sleeve assembly 120. The reamer shoe 100 has an inner diameter larger than the outer diameter of the casing string 110 and is slid over an end of the casing string 110.

Projecting inwardly from an inner wall of the reamer shoe is an annular abutment portion, support ring, support beam or ledge 103 which abuts an end of the casing string 110 to guide the reamer shoe 100 on to the end of the casing 110. When the shoe 100 is slid over the casing string 110, the end of the casing string 110 will abut the abutment portion 103 so the user identifies that the shoe 100 has been fully slid onto the casing 110. Preferably, the abutment portion 103 extends circumferentially around the inner diameter of the reamer shoe 100 and forms an annular protrusion so that the reamer shoe 100 meets with an end of the casing 110.

The annular abutment portion, support ring, support beam or ledge 103 also functions to help the shoe stay in place when the shoe reaches the bottom of the well bore. That is, when the shoe reaches the bottom of the hole the support beam prevents the shoe 100 from moving longitudinally.

The attachment between the reamer shoe 100 and the casing 110 will now be described in detail.

Figure 3:
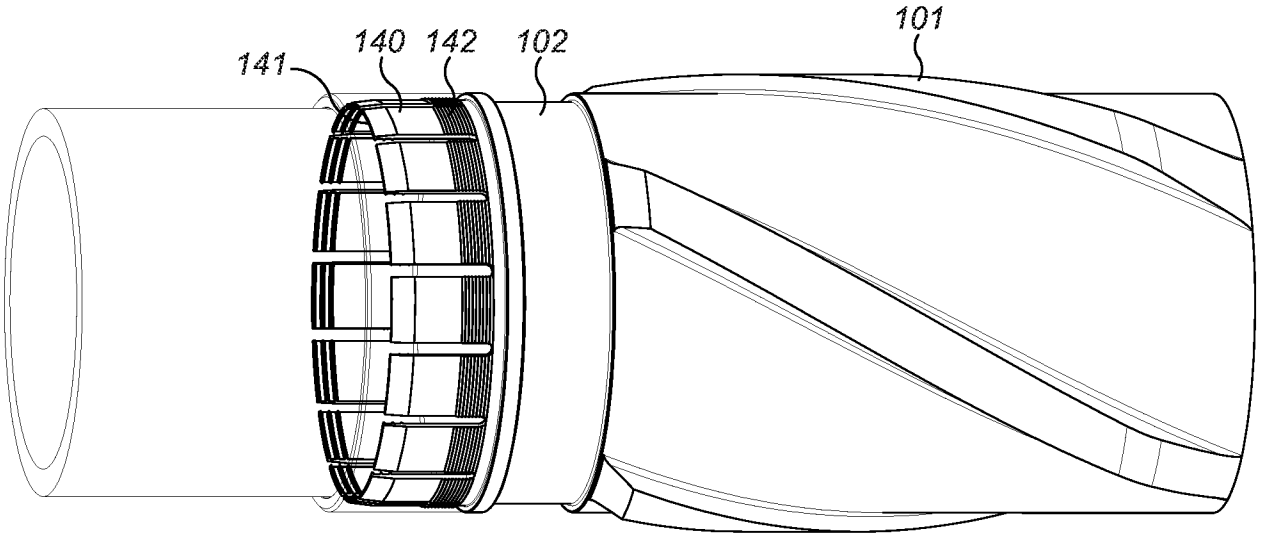
FIG. 3 illustrates a tubular body of float equipment according to an embodiment of the present invention.

FIG. 3 illustrates the tubular body of the reamer shoe and the attachment portion 140. To fix or mount the reamer shoe to the casing string, the attachment portion 140 comprises a plurality of male gripping arms 141 which are arranged to deflect or bend radially inward. The gripping arms are arranged at the proximal end of the shoe 100 opposite to the nose cone 130.

As illustrated in FIG. 2, the reamer shoe 100 is not mounted to the casing string 110 by a thread. Instead, the male gripping arms 141 are bent radially inwards by a female, resilient sleeve 120 which surrounds the attachment portion 140 when the two are press fit tighter. In this way, the male gripping arms 141 provide an inward force against the casing string 110 to fix the shoe 100 to the casing 110.

Figure 4A:
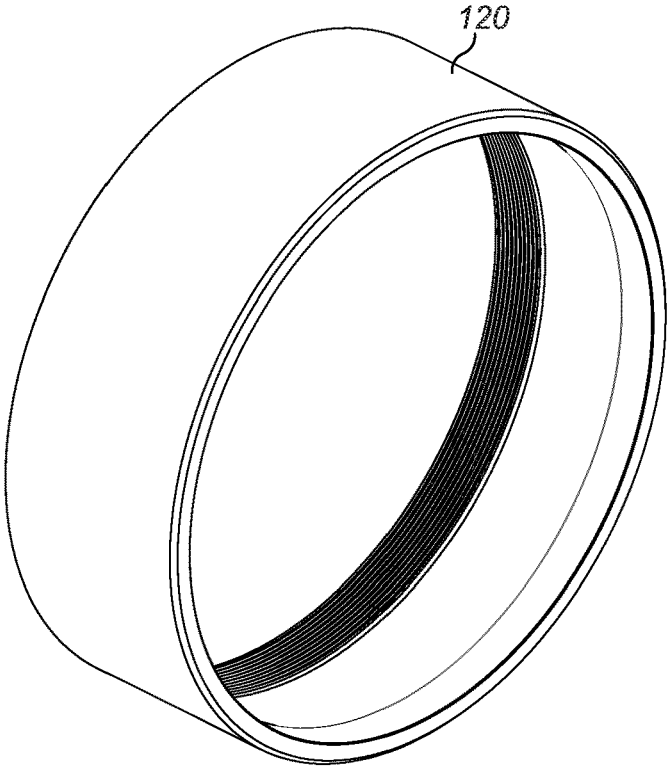
FIGS. 4A to C illustrate an attachment sleeve according to embodiments of the present invention.
Figure 4B:
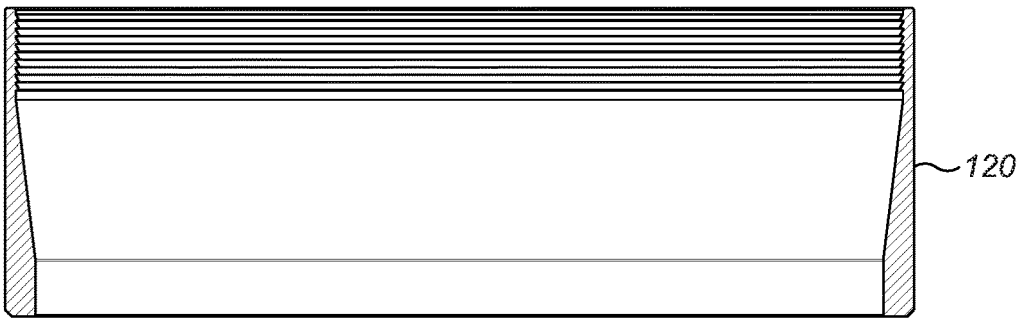
Figure 4C:
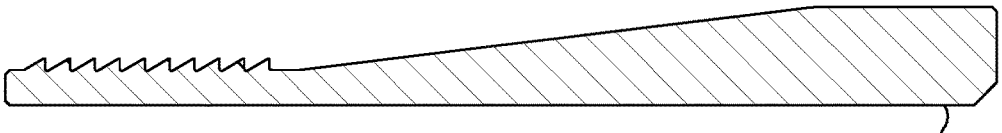

An example sleeve 120 is shown in FIGS. 4*a* to 4*c*. The attachment mechanism is comprised of two parts; namely a male attachment part on the reamer shoe and a sleeve. In use, at least a part of the attachment portion 140 is encircled by the sleeve 120 and the sleeve and attachment portion are together a male-female connection with the sleeve being a female part and the attachment portion being the male part.

The sleeve 120 is shown on its own in FIGS. 4*a* and 4*b*. The cross section of a wall of the sleeve is shown in FIG. 4*c*. The sleeve 120 is substantially tubular. An end section of the wall of the sleeve 120 is tapered along the longitudinal axis of the sleeve 120 and is therefore shaped like part of the surface of the cone. The tapering is shown in FIG. 4*c* where the tapered sleeve causes one end 121 of the sleeve wall to be thicker than the other.

As shown in FIG. 3, the male gripping arms 141 of the attachment portion 140 may themselves be tapered with a narrower outer diameter at the tip of the arm 141, that is, at the proximal end of the arm. In this way, the tapered arm 141 may more effectively abut the tapered sleeve 120.

To attach the reamer shoe 100 to a casing 110, the reamer shoe 100 and the sleeve 120 are slid over the end of a casing 110 and then the attachment portion 140 is press fitted into the sleeve. The attachment portion 140 and the sleeve 120 are positioned on or around the pipe such that the end of the attachment portion 140 with the narrower outer diameter is forced into an end of the sleeve 120 with the larger inner diameter. As the attachment portion 140 is pressed in to the sleeve 120, the conical inner portion of the sleeve causes the male gripping arms to radially deflect inwardly to grip the pipe.

Referring to FIG. 3, one or more ridged grooves/raised ridges 142 may be provided on the outer surface of the attachment portion 140. A plurality of ridged grooves/raised ridges 142 may also be provided on an inner surface of the sleeve. The ridges 142 on the attachment portion and the ridges on the sleeve together form a ratchet so that after the sleeve has been pressed onto a position where it is sufficiently gripped to a pipe, the ratchet holds the attachment portion in position.

As shown in at least FIGS. 4*a* and 4*b*, a portion of the inner surface of the sleeve 120 has a plurality of ridged grooves/raised ridges that extend around the inner circumference of the sleeve 120.

Figure 5:
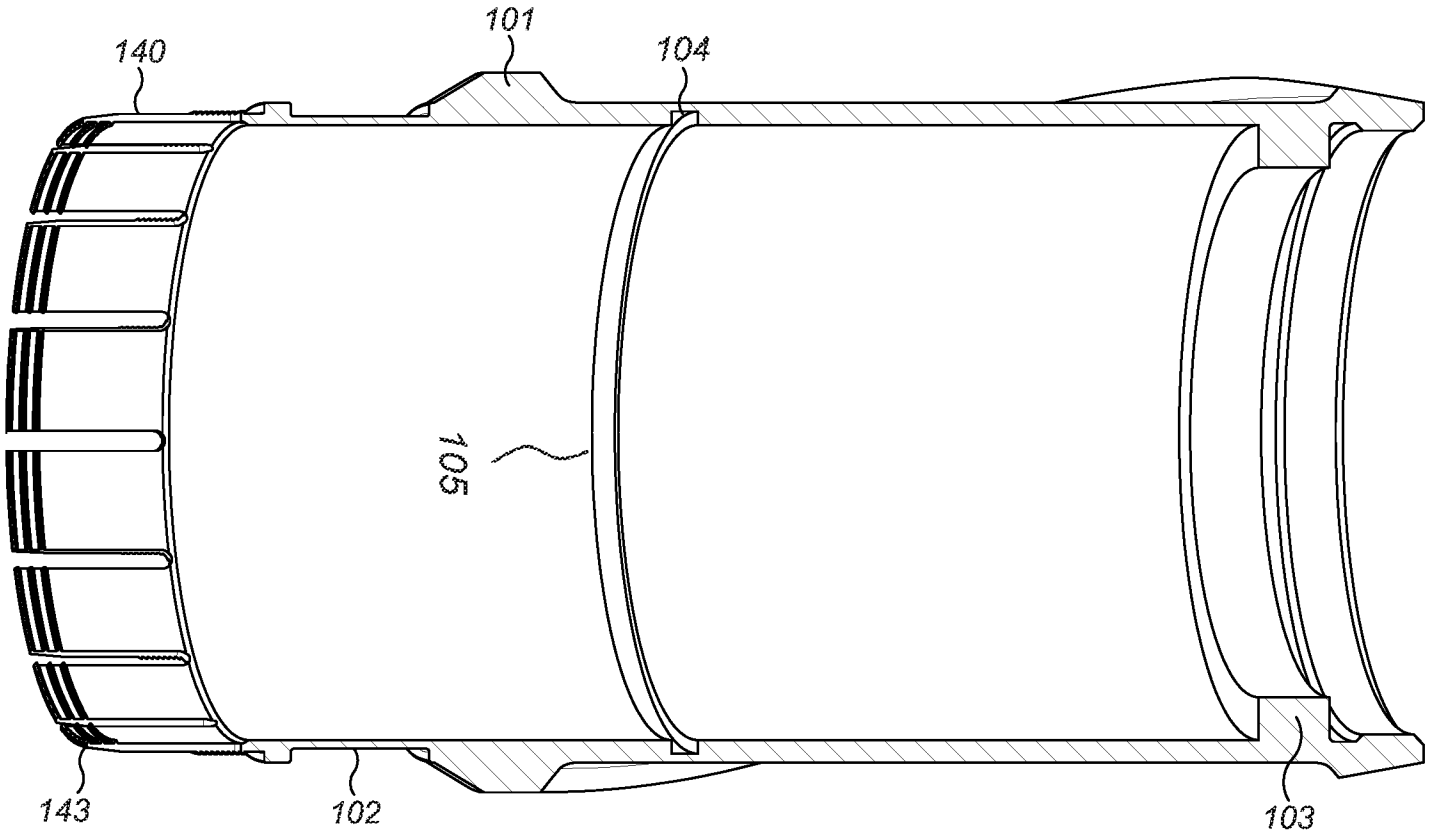
FIG. 5 illustrates a cut-out portion of a tubular body of the float equipment of FIG. 3.

FIG. 5 illustrates a cut-out view of the tubular body of the reamer shoe 100 having the attachment portion 140. The inner surface of the male gripping arms 141 may comprise a plurality of teeth which grip the pipe when the male gripping arms are bent inwardly as the male and female parts are pressed together. That is, when the male and female pressed together, the arms of the male part are bent inwards and it is this bending movement which causes the ends of the arms to grip the pipe.

The teeth may optionally be formed of a plurality of circumferential protrusions 143 on the inner part of the male gripping arms 141 at the proximal end or tip of the arms. Circumferential teeth 143 arranged in this way may prevent axial movement of the shoe relative to the casing 110 by creating an edge which transmits force to the casing.

Figure 13:
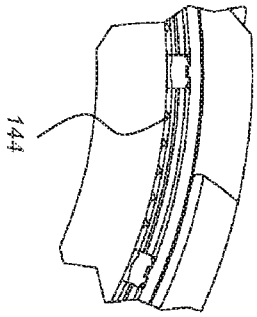
FIG. 13 illustrates a cut-out portion of FIG. 12 in detail, illustrating the longitudinal slits in each gripping arm.
Figure 14:
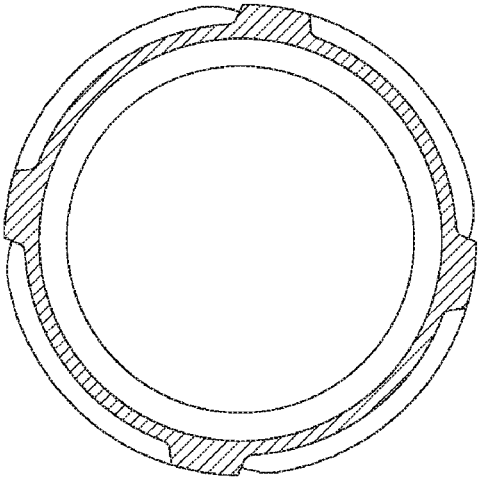
FIG. 14 illustrates a cross section of FIG. 10 taken in the middle section, the spiral arms are shown.
Figure 15:
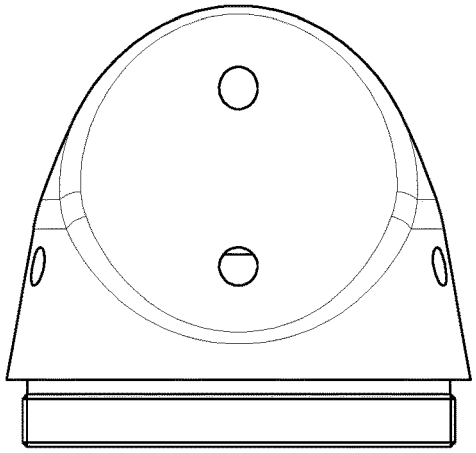
FIG. 15 illustrates a side view of a nose cone according to an embodiment of the present invention.
Figure 16:
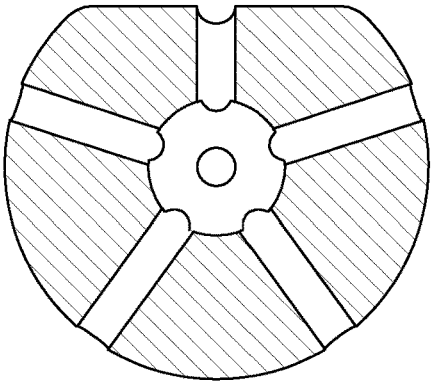
FIG. 16 illustrates a cross section of the nose cone of FIG. 15.
Figure 17:
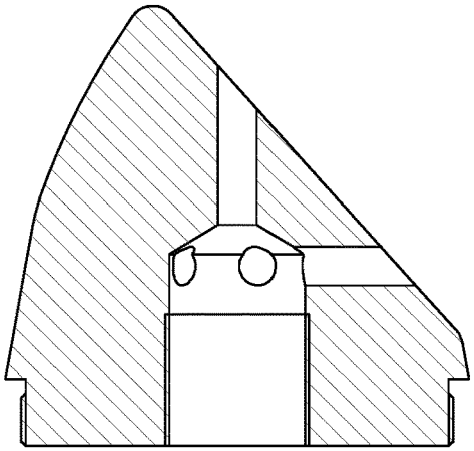
FIG. 17 illustrates a cross section of the nose cone of FIG. 15 taken perpendicular to the cross section of FIG. 16.

The circumferential teeth or circumferential protrusions 143 may further comprise a series of longitudinal slits 144, shown in FIG. 13, in the circumferential teeth of each male gripping arm. Preferably, there are five longitudinal slits for each male gripping arm. The longitudinal slits help to prevent radial movement of the shoe. That is the longitudinal slits create an edge which creates a radial force on the casing 110.

A similar gripping mechanism is described in International patent application WO2014/011056 where the mechanism is utilised as a stop collar. GB1706590.5 describes a modification to the stop collar to support a function element such as a centraliser.

Advantageously, attachment in this way means that reamer shoes can be attached to a pipe by only pressing the male gripping arms into the sleeve. No pins, screws or welding are required to attach the reamer shoe to the pipe. In addition, the pipe diameter that the reamer shoe can be attached to can be within a relatively wide tolerance range as the variable inner circumference of the reamer shoe allows the shoe to be easily attached to pipes with different outer diameters. In addition, the attachment of the male gripping arms to the pipe due to the bending of the arms allows a very strong gripping force to be applied to the pipe. Further advantages include the simple and low cost of construction.

When compared to conventionally mounted float equipment, the mount of the invention allows the shoe to be mounted to different casings which reduces the need for multiple thread options and significantly reduces the cost of equipment manufacture and inventory overheads. The connection of the invention is Independent of weight, grade and thread while preventing fluid and pressure leakage. The two piece design is press-fit together to secure the equipment to the casing off-line. The attachment mechanism delivers extremely high holding forces under all operating conditions.

Additionally, conventional float equipment takes a long time to install as the equipment must be threaded onto the casing. The press-fit connection of the invention is quick and easy and dramatically increases the speed of installation and reduces the overall installation time. Any type of shoe or equipment can be used on the tubing rather than being limited to one by the installation overheads. The float equipment can also be installed using a hand-held tool, which further reduces the installation overheads.

When forcing the male and female parts of the attachment mechanism together, any number of known tools for press fitting tubular parts that are arranged around the pipe may be used. For example, the tool as shown in FIGS. 2 and 3 of U.S. Pat. No. 3,040,405 may be used or any of the tools as disclosed on https://www.aceoiltools.no/ as viewed on 10 Nov. 2017, may be used.

Referring back to FIGS. 1 and 2, to facilitate the press fit of the sleeve and attachment portion, a setting tool groove 102 may be provided in an outer wall of the tubular body of the reamer shoe 100. The groove 102 is arranged to receive a first part of the setting tool, the second part of the second tool arranged at an opposite side of the sleeve such that when the two parts of the setting tool are forced together, the sleeve and the attachment portion are press-fit together.

The male gripping arms may also be referred to as fingers, deformable members or other interchangeable terminology to describe a plurality of elements which extend from a base toward a tip and bend inwardly to grip the pipe, the elements being separated by slots extending from the tip to the base. Fingers of the attachment portion interface with the female part of the attachment mechanism, that is, the sleeve. The fingers are created providing a plurality of equal length, linear and axially aligned slots from the proximal end of the male part. A finger is formed between any two adjacent slots. Each of the fingers extends axially away from a body of the reamer shoe that is from a body of the male part.

Referring to FIGS. 2 and 5, there is provided on the inner surface of a tubular portion a groove for receiving a seal. The groove may be positioned between the attachment portion 140 and the casing abutment portion 103 so that a seal can be created between the tubular body of the reamer shoe 100 and an outer wall of the casing string 110 when the reamer shoe 100 is mounted onto the casing string 110. Preferably the groove is an annular groove extending circumferentially around the inner surface of the tubular body of the reamer shoe and is arranged toward the leading end of the reamer shoe.

The seal provided in the groove may be any type of mechanical or expandable seal, for example. Any seal may be used suitable to seal pressure between the shoe body and the casing. For example, a seal may be provided without a groove.

In conventional float equipment the shoe is mounted by a thread to the end of the casing. The threaded connection does not typically allow for fluid or pressure leakage. The seal groove and seal provided in the reamer shoe illustrated in FIGS. 2 and 5 prevents any fluid or pressure leakage. This allows fluid to be ejected straight out of the nose of the shoe.

To vary the pressure in the casing, an optional check valve 134 may be provided as described below.

To adapt the described reamer shoe to existing casing strings having threaded end portions, the shoe may be provided with an annular support ring to stiffen the assembly. Typical casing strings have threads which decrease in outer diameter towards the end of the casing, that is, the casing is conical in shape at its end. If the described shoe is installed on such a string, there is potential for a gap to be created between the casing and the shoe body. A support ring may be installed to meet the inner diameter of the show to the outer diameter of the casing to add stiffness.

Figure 6:
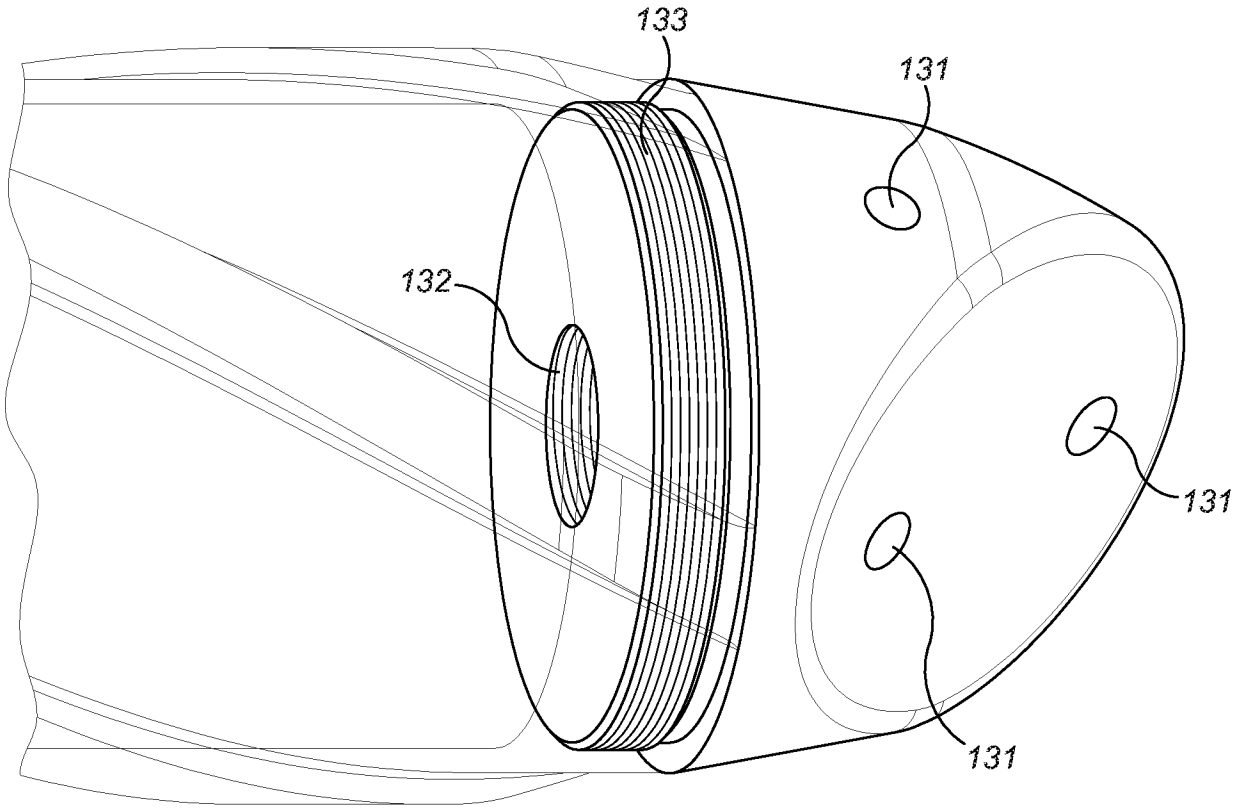
FIG. 6 illustrates a nose cone according to embodiments of the present invention.
Figure 7:
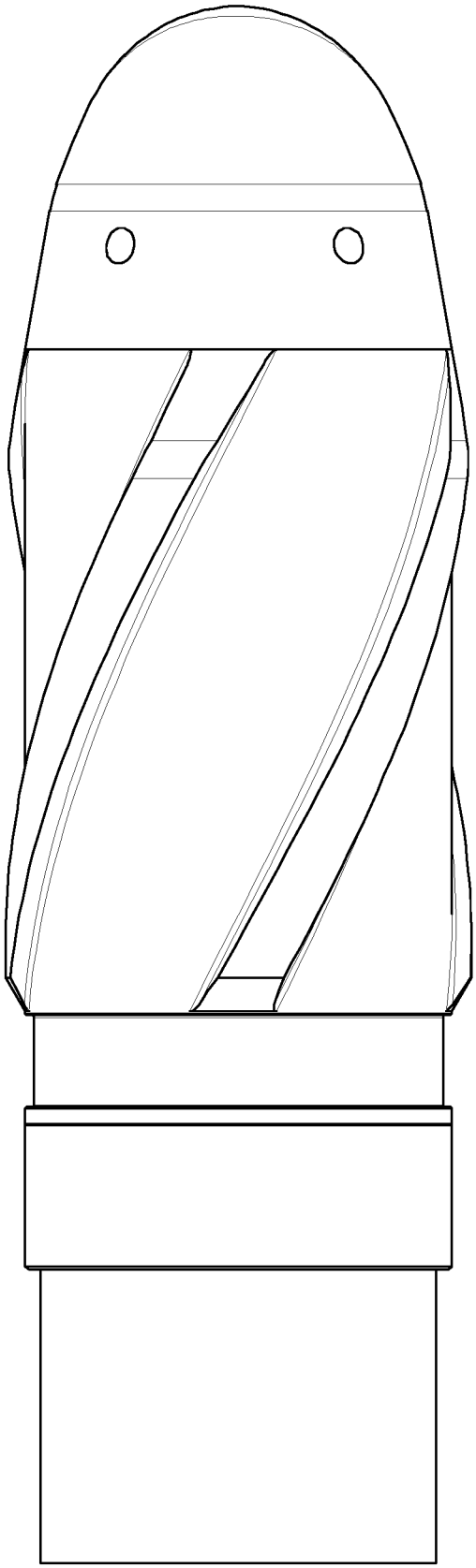
FIG. 7 illustrates float equipment and attachment sleeve assembly mounted onto a tubing according to an embodiment of the present invention.
Figure 8:
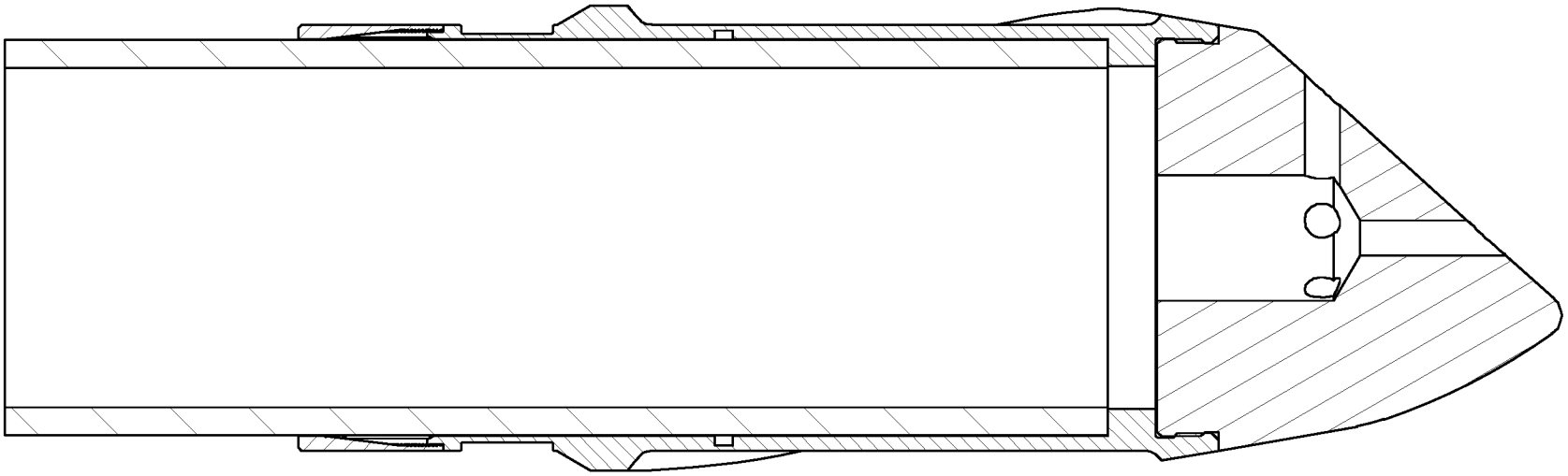
FIG. 8 illustrates a vertical cross section of the float equipment, attachment sleeve assembly and tubing of FIG. 7.
Figure 9:
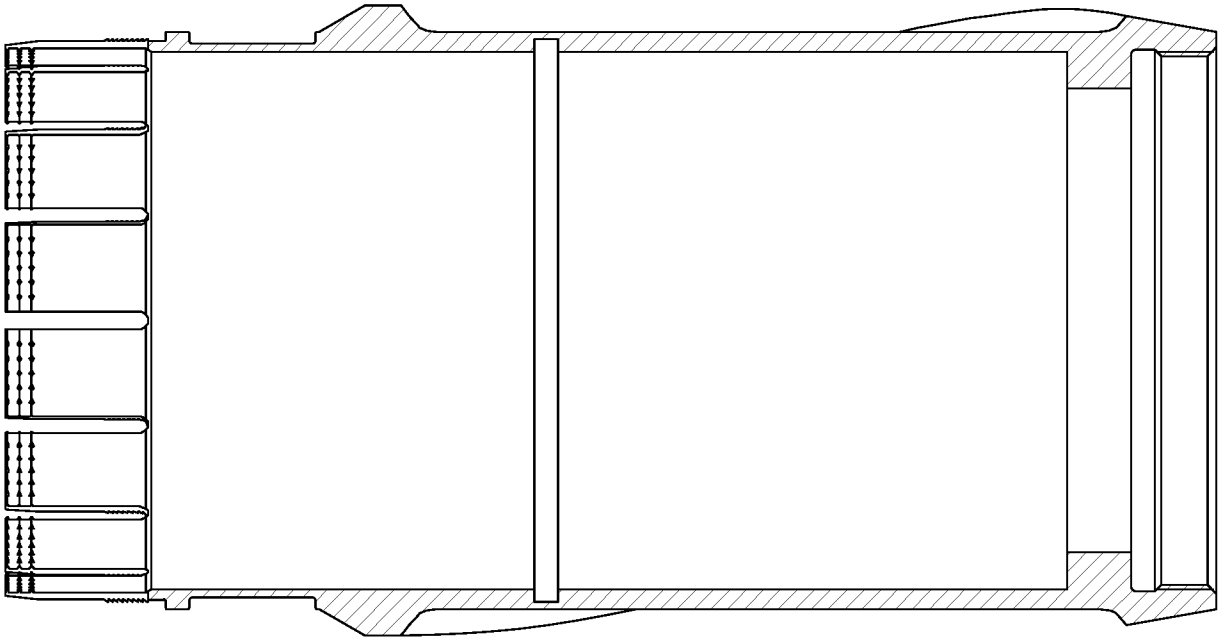
FIG. 9 illustrates a cross section of a tubular body of float equipment according to an embodiment of the present invention.
Figure 10:
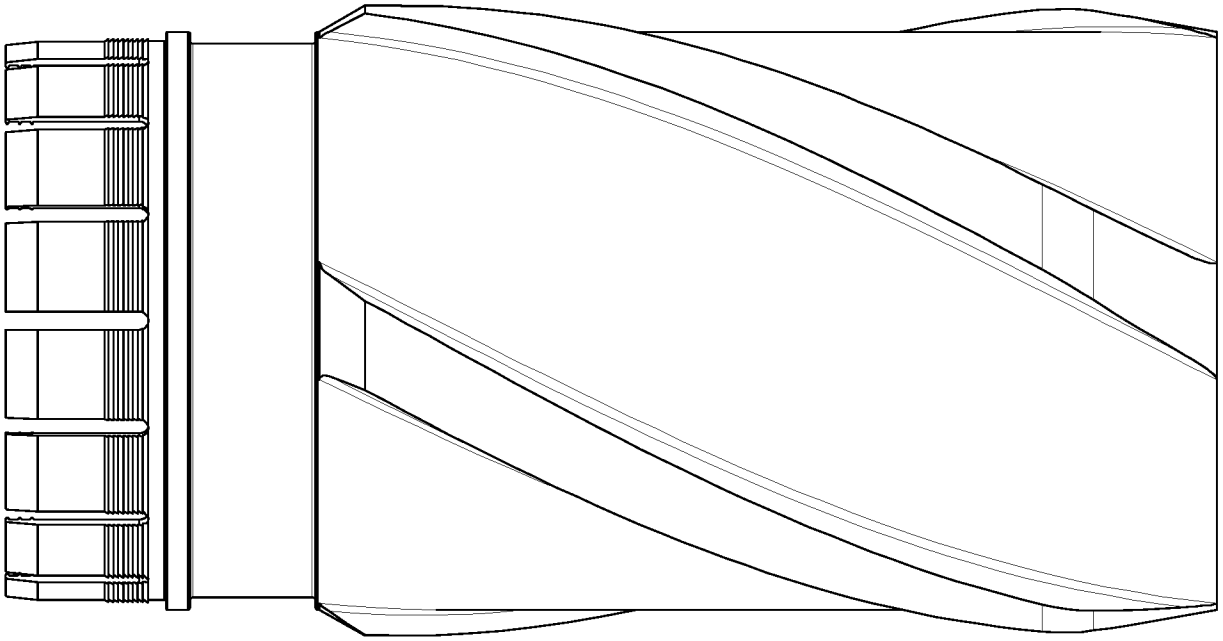
FIG. 10 illustrates a tubular body of float equipment according to an embodiment of the present invention.
Figure 11:
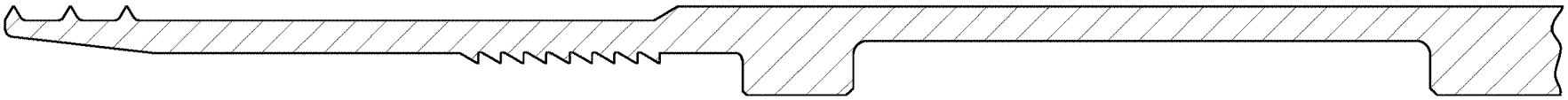
FIG. 11 illustrates a gripping arm of float equipment according to an embodiment of the present invention.
Figure 12:
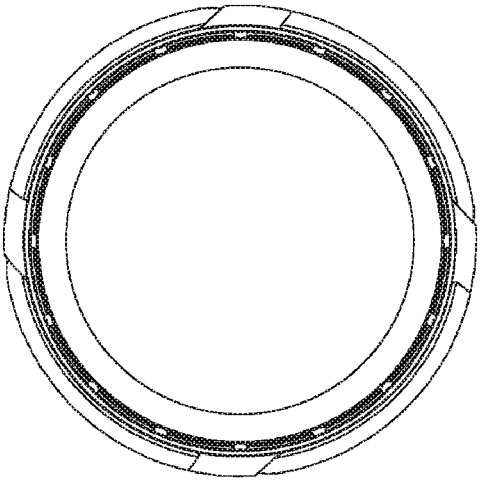
FIG. 12 illustrates a longitudinal view of the tubular body of the float equipment of which the illustration of FIG. 9 is a vertical cross sectional view.

It was mentioned above that the reamer shoe 100 may comprise a tubular body or reaming portion, an attachment portion, and a nose cone 130. FIG. 2 illustrates a cross-section of the eccentric nose cone 130 mounted onto the tubular body. FIG. 6 illustrates the nose cone on its own. The eccentric cone 130 may be mounted on to the reamer shoe 100 using threaded end connections 133. The nose cone 130 may be integral with the shoe without threaded connections or may be removable. The potential to add a separate nose cone 130 increases the utility of the float equipment. A purpose-specific nose cone 130 may be threaded onto the float equipment depending on the application.

FIG. 5 illustrates a seal groove 104 on the interior of the tubular body for mounting the nose cone to the shoe. A seal 105 may also be provided between the nose cone and the shoe body.

The eccentric nose cone 130 illustrated in FIG. 6 may comprise channels 131 which allow for fluid communication between the interior of the nose cone and the exterior of the reamer shoe, as indicated above. This fluid communication provides for the flow of lubricant.

On the interior of the nose cone 130 may be a threaded portion 132 to allow for a check valve to be threaded longitudinally into the interior of the nose cone 130.

Once threaded into the nose cone 130, one side of the check valve is in fluid communication with the interior of the casing string and the other side of the check valve is in fluid communication the inner part of the channels 131. Thus, the threaded portion for the check valve (and the check valve when mounted) provide an interface between the interior of the casing string and the exterior of the reamer shoe at the well bore end, in use, so that fluid inserted into the casing flows via the check valve and through the channels onto the wall of the well bore and/or into the well bore to provide lubrication to the reamer shoe and to provide fluid to well bore obstructions. The threaded connection 132 in the nose cone 130 allows for a valve with different properties to be inserted into the shoe 100.

A check valve may be provided in the interior of the shoe body rather than the nose cone to provide for pressure to be regulated. The valve is optional to prevent backflow.

FIGS. 7 to 17 illustrate alternative views of the above described figures.

The attachment sleeve and reamer shoe assembly according to embodiments of the invention are suitable for industrial applications, in particular for use in the subsea oil and gas industry. The elements of the assembly may be made of any material known for such applications, such as steel.

Embodiments are particularly appropriate for the oil and gas industry, in particular for the preparation of drill holes subsea in these industries. The dimensions of the components described may be adapted as required to the pipes and other devices used in these industries.

The invention claimed is:

1. A float equipment attachment assembly comprising:

a float equipment for mounting to a tubing string, the float equipment comprising a tubular body and a plurality of gripping arms extending longitudinally away from the tubular body arranged to deflect radially inwards; and, an attachment sleeve, wherein an inner diameter of the attachment sleeve is tapered to form a conical abutment portion, wherein, when the attachment sleeve and float equipment are arranged axially around the tubing string and are pressed together, the gripping arms are deflected radially inward by the conical abutment portion to grip the tubing string to mount the float equipment to the tubing string; and the float equipment further comprises a seal groove in an inner wall of the float equipment and configured to retain a seal within the seal groove to seal between the float equipment and the tubing string when the float equipment is mounted on the tubing string.

2. The float equipment attachment assembly according to claim 1, in which the seal groove is annular and extends circumferentially around the inner wall of the tubular body.

3. The float equipment attachment assembly according to claim 1, in which the float equipment further comprises an annular seal arranged on an inner wall of the tubular body.

4. The float equipment attachment assembly according to claim 1, in which the float equipment further comprises a casing abutment portion protruding inwardly from an inner wall of the tubular body so as to abut an end of the tubing string when the float equipment is slid over the tubing string.

5. The float equipment attachment assembly according to claim 4, in which the casing abutment portion is annular and extends circumferentially around the inner wall of the tubular body.

6. The float equipment attachment assembly according to claim 1, wherein each gripping arm comprises a plurality of gripping teeth arranged on an inner wall of the gripping arms.

7. The float equipment attachment assembly according to claim 6, in which the teeth extend circumferentially around the inner wall of the gripping arms.

8. The float equipment attachment assembly according to claim 7, in which each male gripping arm comprises at least one longitudinal slit in the circumferential gripping teeth.

9. The float equipment attachment assembly according to claim 8, in which each gripping arm comprises five longitudinal slits.

10. The float equipment attachment assembly according to claim 1, further comprising a plurality of circumferential ridges on an outer wall of the male gripping arms which are arranged to cooperate with corresponding circumferential ridges on the inner wall of the sleeve to form a ratchet.

11. The float equipment attachment assembly according claim 1, in which the gripping arms are tapered so that the outer diameter of the gripping arm increases from a tip of the gripping arms toward the tubular body.

12. The float equipment attachment assembly according to claim 1, in which the float equipment further comprises a tool groove extending circumferentially around an outer wall of the float equipment to receive a part of a setting tool.

13. The float equipment attachment assembly according to claim 1 in which the float equipment is a reamer shoe.

14. The float equipment attachment assembly according to claim 13, in which the reamer shoe comprises an eccentric nose cone mounted on the tubular body.

15. The float equipment attachment assembly of claim 13, wherein the reamer shoe is configured to mount to an end of the tubing string, and the annular groove is located in the inner wall of the float equipment at a position towards a leading end of the reamer shoe, wherein the reamer shoe is configured to eject fluid from a nose of the reamer shoe.

16. The float equipment attachment assembly according to claim 1, in which the float equipment further comprises one or more channels extending through a wall of the float equipment to allow fluid communication between the tubing string and a well bore.

17. The float equipment attachment assembly according to claim 1, in which the float equipment further comprises an internal threaded portion for receiving a check valve.

18. The float equipment attachment assembly according to claim 1, in which the tubular body comprises one or more reamer members or one or more spiral centraliser arms, or both.

19. The float equipment attachment assembly according to claim 1, further comprising a support ring adapted to reduce the effective inner diameter of the tubular body to conform to a conical threaded portion of the tubular string.

20. The float equipment attachment assembly according to claim 1, in which the tubular body comprises a threaded connection for receiving a nose cone.

21. A method of mounting a float equipment to a tubing string comprising:

sliding an attachment sleeve onto the tubing string;

sliding the float equipment onto an end of the tubing string;

aligning a longitudinal axis of a substantial tubular end part of the attachment sleeve with a longitudinal axis of a substantial tubular end part of the float equipment;

applying a force that moves an end part of the sleeve and an end part of the float equipment relatively toward each other along the longitudinal axis so that contact between the sleeve and the float equipment causes each of a plurality of gripping arms on an end part of the float equipment to deflect radially inward; and sealing a flow path of fluid from the tubing string external the float equipment between the tubing string and the float equipment with a seal retained within a seal groove in an inner wall of the float equipment that engages an outer wall of the tubing string.

* * * * *